US008727653B2

(12) United States Patent
Nelson

(10) Patent No.: US 8,727,653 B2
(45) Date of Patent: May 20, 2014

(54) MULTI-POCKETED FOLDING ORGANIZER

(76) Inventor: Natalie F. Nelson, Baltimore, MD (US)

( * ) Notice: Subject to any disclaimer, the term of this patent is extended or adjusted under 35 U.S.C. 154(b) by 305 days.

(21) Appl. No.: 12/753,431

(22) Filed: Apr. 2, 2010

(65) Prior Publication Data

US 2010/0252553 A1 Oct. 7, 2010

Related U.S. Application Data

(60) Provisional application No. 61/166,402, filed on Apr. 3, 2009, provisional application No. 61/260,596, filed on Nov. 12, 2009.

(51) Int. Cl.

| | |
|---|---|
| ***B42F 13/00*** | (2006.01) |
| ***B42D 3/12*** | (2006.01) |
| ***A45C 11/34*** | (2006.01) |
| ***B65D 69/00*** | (2006.01) |
| ***B65D 71/00*** | (2006.01) |

(52) U.S. Cl.

USPC ..... 402/79; 281/30; 281/31; 206/214; 206/223

(58) Field of Classification Search

USPC ..... 281/30, 31; 402/79; 220/6; 206/214, 206/748, 449, 450

See application file for complete search history.

(56) References Cited

U.S. PATENT DOCUMENTS

| | | | | |
|---|---|---|---|---|
| 1,085,950 | A * | 2/1914 | Steinthal | 190/16 |
| 1,545,577 | A * | 7/1925 | Arms | 150/147 |
| 5,020,673 | A * | 6/1991 | Adams | 206/214 |
| 6,578,706 | B2 * | 6/2003 | Thompson | 206/214 |
| 6,666,610 | B1 | 12/2003 | Moor et al. | |
| 6,899,836 | B2 | 5/2005 | Samant et al. | |
| D522,577 | S | 6/2006 | Smith | |
| 7,281,877 | B1 * | 10/2007 | Lederer et al. | 281/31 |
| 7,458,501 | B1 | 12/2008 | Pelleg | |
| 2001/0019206 | A1 * | 9/2001 | Deans | 402/79 |
| 2002/0121775 | A1 | 9/2002 | Sperry | |
| 2006/0008320 | A1 | 1/2006 | Spaulding | |
| 2006/0039745 | A1 | 2/2006 | Menders | |
| 2006/0261592 | A1 | 11/2006 | O'Keefe | |

OTHER PUBLICATIONS

"Stamp Accessories Kit," [retrieved from the Internet at http://www.orientaltrading.com on Jun. 1, 2009].

"Craft Logic Scrapbook & Craft Portable Organizer Tote," [retrieved from the internet at http://www.creativecraftwarehouse.com on Jun. 1, 2009].

"Craft Logic Scrapbook & Craft Portable Organizer Tote," [retrieved from the internet at http://www.creativecraftwarehouse.com/product/SCRAPBOOKORGANIZER on Jun. 1, 2009].

* cited by examiner

*Primary Examiner* — Kyle Grabowski

(74) *Attorney, Agent, or Firm* — Gianna Julian-Arnold; Saul Ewing LLP

(57) ABSTRACT

A multi-pocketed decorative fabric organizer that resembles a folding file and serves as a workspace when opened and then folds up in seconds keeping all the items and materials stored in it intact, and provides a portable and compact organizer for various purposes. The organizer consists of a hard surface that folds out to a writing or working space consisting of conveniently located plastic storage pockets and an exterior of decorative fabrics.

11 Claims, 7 Drawing Sheets

6A

6B

6C

MULTI-POCKETED FOLDING ORGANIZER

CROSS REFERENCE TO RELATED APPLICATIONS

This application seeks priority to U.S. provisional applications Nos. 61/166,402 filed Apr. 3, 2009 and 61/260,596 filed Nov. 12, 2009.

FIELD

The device disclosed herein generally relates to a file folio, and in certain embodiments it more particularly relates to a multiple compartment filing system.

BACKGROUND

There is a need for storage systems or organizers in order to keep track of various parts of a project such as a scrapbook, or memorabilia such as photographs, or other hobby-related items such as puzzle pieces or embroidery etc., or for travel convenience such as a make-up or toiletry organizers. The demand for organizing systems has been so great recently, that many stores dedicate whole sections to simply provide various organizers for things used in everyday life, such as container stores, art supply stores, arts and crafts stores, among many others. People use many areas in their homes and offices to spread out such work and have the risk of losing parts of a project if a system to organize components is unavailable. Preservation of memorabilia is another fond tradition in many families and inventions for this purpose are also very popular.

Reduction of clutter and preserving the various stages of a project has led to a spurt in various products for storage and organization. Devices have various embodiments such as file folders, expandable compartments, folding options, panels, separators, and pockets, allowing a user to decide how to use a device to serve the need for organizing their paraphernalia or memorabilia. The present invention is another such device and system to provide an file folder type organizer for scrapbooking, keeping bills, notes, work related documents event notebook or netbook computers.

Such organizers can be made of various materials (i.e. wood, plastic, metal, cloth, etc.); from rigid materials to flexible materials. However, many of these products take up much space and do not provide access and visualization of all materials or documents.

U.S. Pat. No. 6,889,836, herein incorporated by reference in its entirety describes an apparatus for organizing and retaining memorabilia.

U.S. Publication No. 2006/0039745 A1, herein incorporated by reference in its entirety describes a device for use in an organizational system for facilitating the preparation of layouts which are to be included in a scrapbook.

U.S. Publication No. 2002/0121775 A1, herein incorporated by reference in its entirety describes a system for organizing and storing scrapbooking material.

Therefore, there is a continuing unmet need for storage apparatuses which are flexible, provide easy access and viewing of materials and are durable to wear and tear.

SUMMARY

Described herein is a multi-pocketed decorative fabric organizer that resembles a folding file. The product serves as a workspace when opened and then folds up in seconds, keeping all the items and materials stored in it intact, and provides a portable and compact organizer for various purposes. The organizer consists of a hard surface that folds out to a writing or working space consisting of conveniently located plastic storage pockets and an exterior of decorative fabrics.

Figure 1:
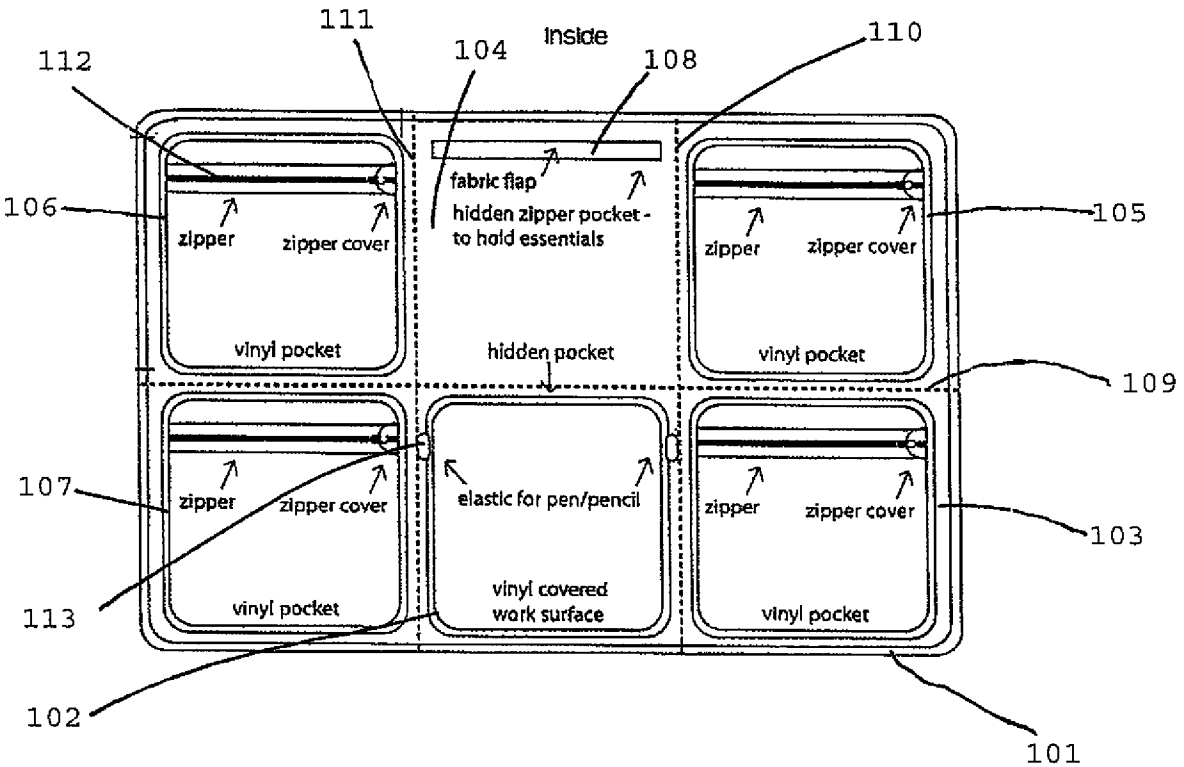
FIG. 1 illustrates various pockets of the system used for various purposes.
Figure 2:
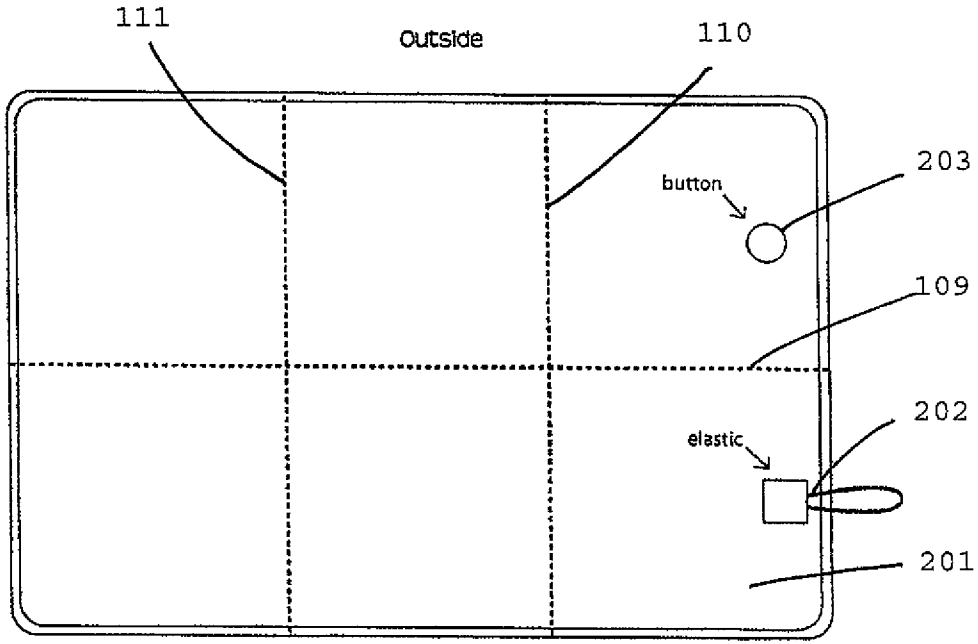
FIG. 2 illustrates an external view of the system with securing button and elastic to hold folded system in place.
Figure 3:
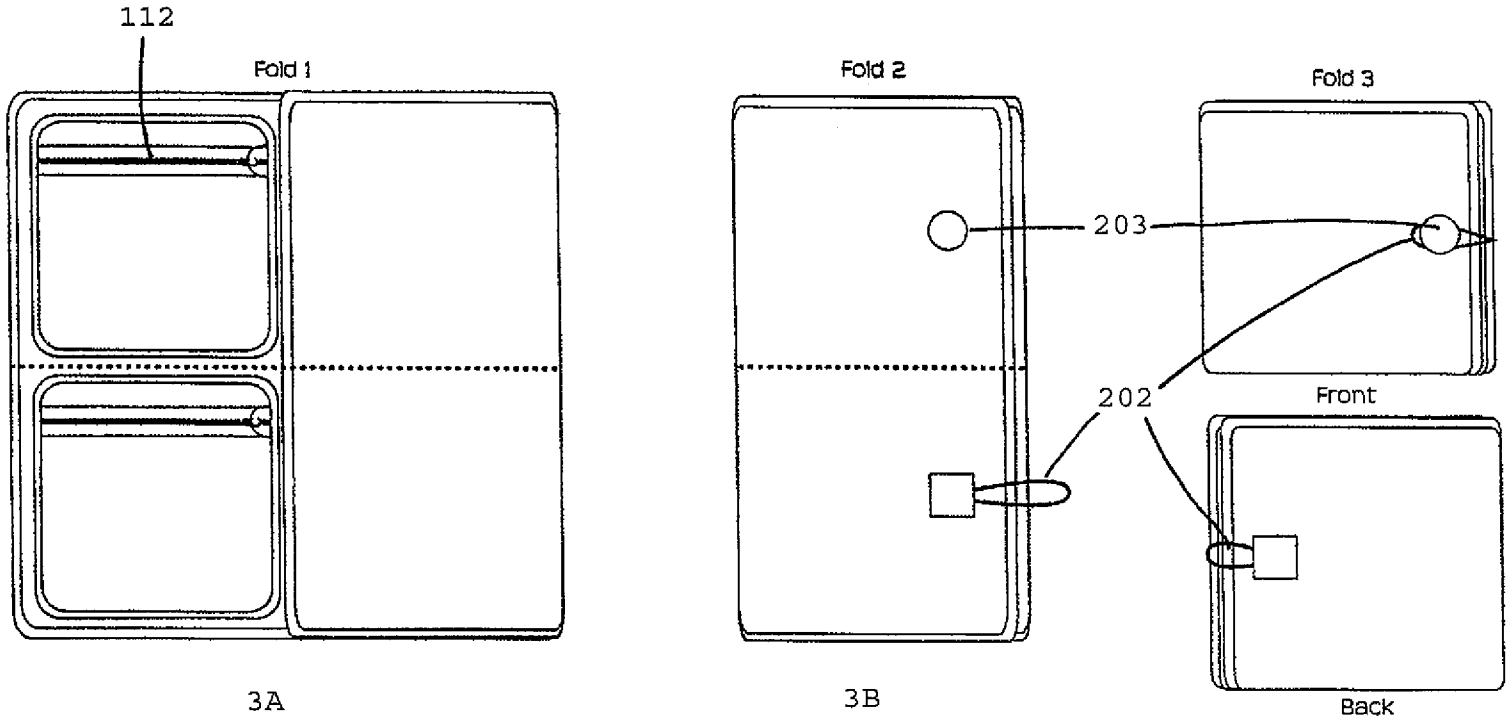
FIG. 3 illustrates zippers pockets and buttoned or elastic tabs for pocket folds.
Figure 4:
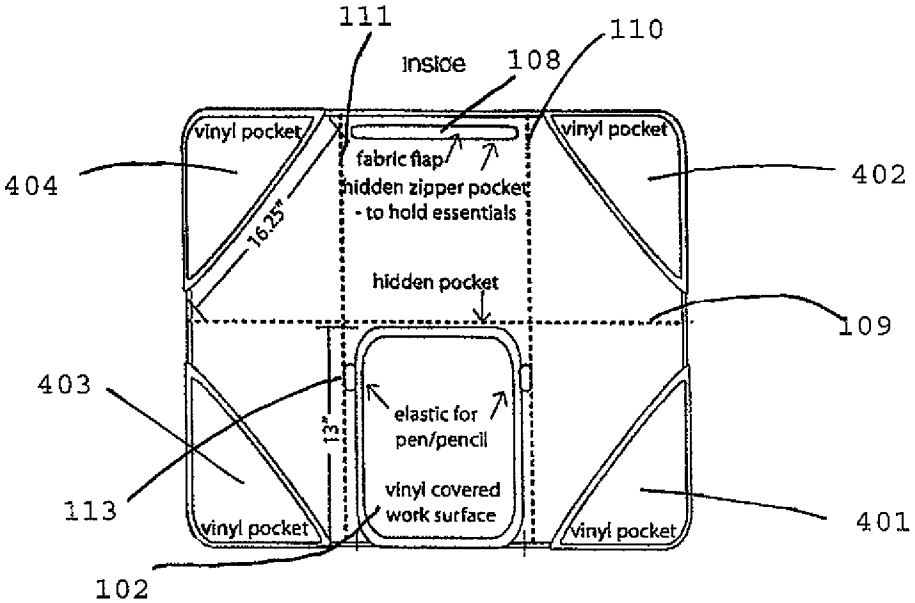
FIG. 4 illustrates other types of pockets.
Figure 5:
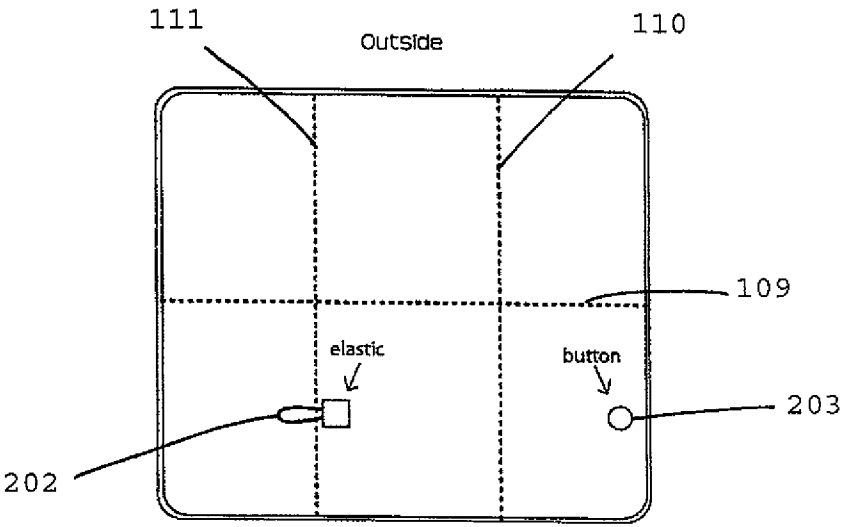
FIG. 5 illustrates another external view of the system.
Figure 6:
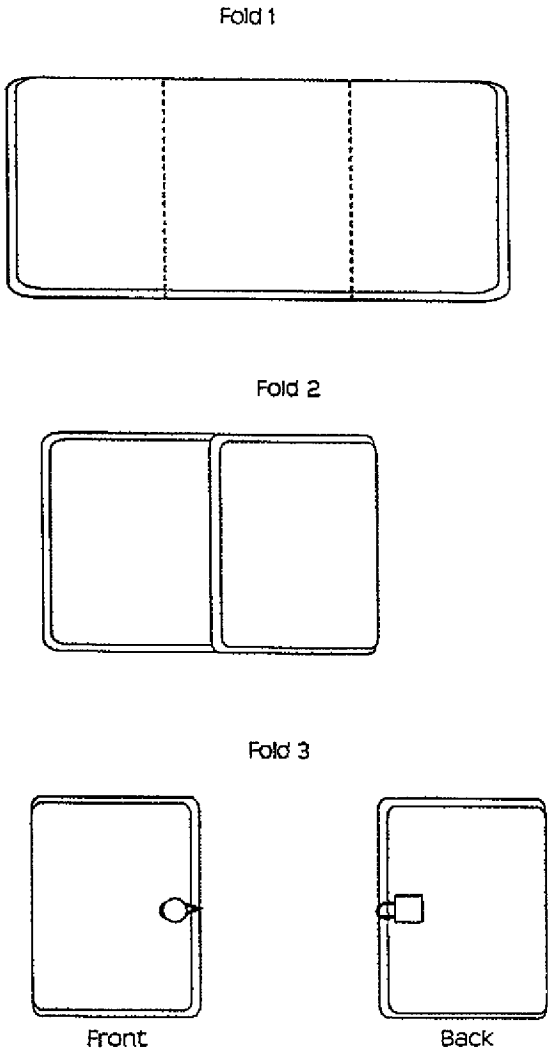
FIG. 6 illustrates the folded system from the front and back.
Figure 7:
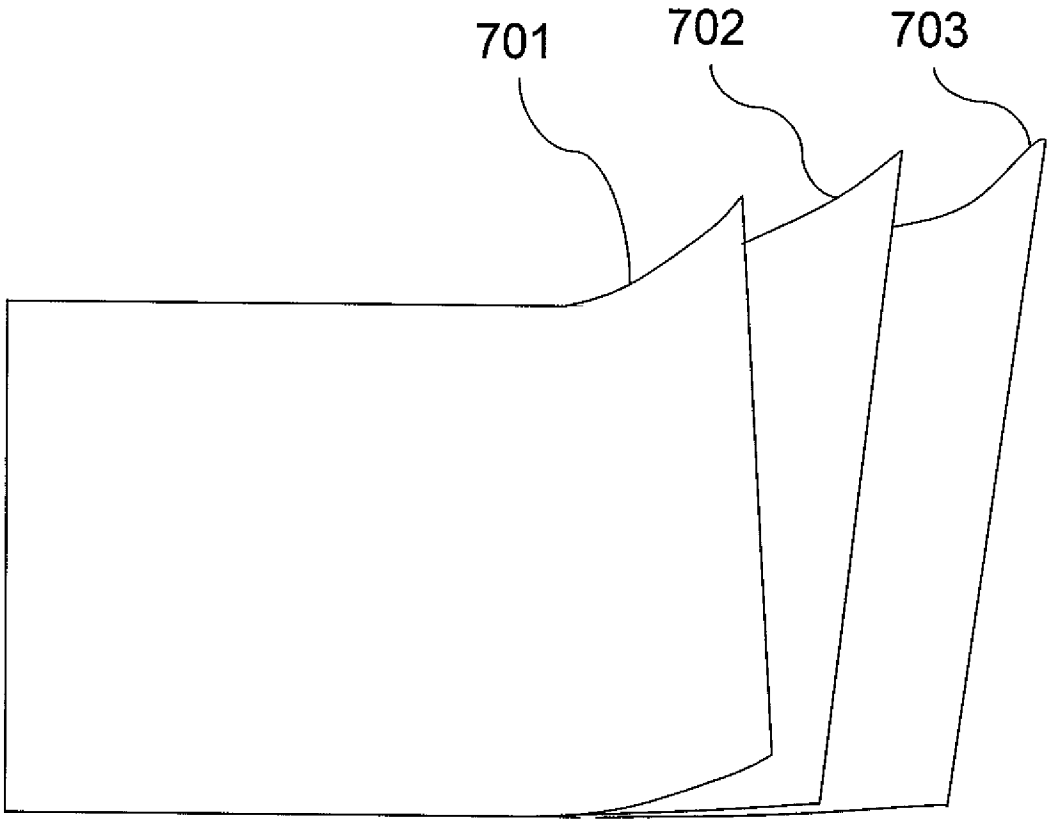
FIG. 7 illustrates the three layers of materials used to make the present invention.

Having described generally the present invention and its objectives, the full scope of the present invention will be appreciated by those skilled in the art upon a review of the following detailed description of the preferred embodiment of the invention which is made in conjunction with the attached drawings. In the following description of the preferred embodiment of the invention, like numerals refer to like elements of the invention.

DETAILED DESCRIPTION

An aspect provides people, who currently find themselves using the kitchen table or any other common area around the home as a workspace, a better way to both work from home and stay more organized. The system identified by trademark—File with Style!™—is an innovative and elegant organizational system that combines function and decorative flair. The system allows anyone working from home to transform their workspace within seconds into a convenient, stylish multi-pocketed fabric file that, when re-opened, will allow users to return to work with all of their materials intact and stored in place and ready-to-go.

The system is designed to provide the many people working from their homes with a convenient way to stay organized when they need to pack up items relating to an on-going project and clear the work table when guests arrive or during other times in day-to-day life. Whether paying the bills, helping children with homework, or engaging in a scrapbooking project, more people than ever are using the kitchen and/or dining room table, as well as the floor of their homes or work areas for various projects. The invention makes it possible to go from the perfect workspace, to an organized file, and back to the perfect workspace, all within seconds, and without disrupting their work.

The present invention can be constructed in various sizes, designs and patterns, to meet the different needs of bill payers and for people who like creating scrapbooks. In addition to its interior design, consisting of a rigid or semi-rigid surface (201) that can, in alternate embodiments, fold out to a writing and/or working space, which writing and/or working space can be part of the multi-sectioned storage apparatus and conveniently located plastic storage pockets (401, 402, 403, 404), the system is made using beautiful, high quality fabrics and offers a stylish, colorful alternative to traditional filing or storage systems.

Provided herein is a storage apparatus (101) comprising: a planar tetragonal first layer of material (701); at least one middle layer of support material (702); a third layer of material (703) in certain embodiments additional or supplemental layers of various materials having different characteristics, such as softness, rigidity, water-resistance, as are known in the art can be included; at least two latitudinal creases (110, 111), in four quadrant embodiments of the invention there may be at least one latitudinal crease, and at least one longitudinal crease (109) to facilitate folding and to form at least six regions (102, 103, 104, 105, 106, 107) affixed to the third layer of material wherein the center bottom region (102) comprises a work surface, the work surface may be of rigid or semi-rigid materials, and a closure (113) affixed to the first layer of material to secure the apparatus upon folding. Each element of the invention may be fixed by fusion, heat, stitching, gluing, or other means of attaching or fixing materials together as are known in the art.

The present invention may also include a water-resistant covering which protects materials and documents from damage in said first layer of material.

The regions of the present invention may also comprise a pocket (108). The pocket of the present invention may comprises a closing means (202, 203). The pockets of the present invention may further comprise an additional layer of material fused to the third layer to form a pocket. The pockets of the present invention may comprise an opening in said third layer, wherein the boundary of said pockets can be formed by fusing stitching, gluing, etc., and other materials as are known in the art the first, second and third layers of material together in a shape to form a pocket for storage.

The closing means of the present invention may comprise a device selected from the group consisting of a zipper (112) (any interlocking closure—"ziplock" or "tooth and lock"), button (203), snap (202), hook and eye closure. The closure of the present invention may comprise a closure selected from the groups consisting of a hook and loop material, snap, tie and button. The closure of the present invention may further comprise a hook and loop material.

The present invention may comprise a horizontal edge from about 18 inches to about 56 in length and a vertical edge from about 18 inches to about 37 in length. It is an embodiment of the invention where the length of the apparatus is between about 18 inches to about 56 inches in length. However, the sizes and dimensions of the storage apparatus can be of any size depending on design choice to meet particular needs as are known in the art.

The first material of the back (701) may comprise any material selected for practical, e.g. absorptive, decorative, water-resistance, color or design purposes. Also in certain embodiments, greater resistance to damage and wear and tear required such that materials with greater outer rigidity or resistance to damage may be used.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the invention have been described in terms of preferred embodiments, those skilled in the art will recognize that the embodiments of the invention can be practiced with modification within the spirit and scope of the appended claims.

Each of the applications and patents cited in this text, as well as each document or reference, patient or non-patient literature, cited in each of the applications and patents (including during the prosecution of each issued patent; "application cited documents"), and each of the PCT and foreign applications or patents corresponding to and/or claiming priority from any of these applications and patents, and each of the documents cited or referenced in each of the application cited documents, are hereby expressly incorporated herein by reference in their entirety. More generally, documents or references are cited in this text, either in a Reference List before the claims; or in the text itself; and, each of these documents or references ("herein-cited references"), as well as each document or reference cited in each of the herein-cited references (including any manufacturer's specifications, instructions, etc.), is hereby expressly incorporated herein by reference.

The invention claimed is:

1. A storage apparatus comprising:

a planar tetragonal first layer of material;

at least one middle layer of support material, wherein said first layer of material is affixed at least in part to said at least one middle layer of support material;

a third layer of material, wherein said third layer of material is affixed at least in part to said at least one middle layer of support material;

at least two longitudinal creases and at least one latitudinal crease for folding purposes and to form at least six regions within said third layer of material, said six regions comprising left top, center top, right top, left bottom, center bottom, and right bottom, wherein said center bottom comprises a work surface and wherein said work surface is rigid or semi-rigid;

an opening in said center top to form a first pocket between the middle layer of support material and the third layer of material; and a closure affixed to the first layer of material to secure the apparatus upon folding, wherein each one of said at least six regions is substantially equal in area, and wherein said apparatus assumes an area substantially equal to one of said at least six regions when said apparatus is fully folded at all of said latitudinal and longitudinal creases and further secured by said closure.

2. The storage apparatus of claim 1, wherein said first layer of material is a water-resistant covering which protects materials and documents from damage.

3. The storage apparatus of claim 1, comprising two or more pockets.

4. The storage apparatus of claim 3, each said pocket comprising a closing means.

5. The storage apparatus of claim 4, wherein said closing means comprises a device selected from the group consisting of a zipper (any interlocking closure—"ziplock" or "tooth and lock"), button, snap, hook and eye closure.

6. The storage apparatus of claim 4, wherein said closing means is a zipper.

7. The storage apparatus of claim 3, wherein said pockets further comprise an additional layer of material fused to the third layer to form a pocket.

8. The storage apparatus of claim 3, wherein said pockets comprise an opening in said third layer, wherein the boundary of said pockets are formed by fusing the first, second and third layers of material together in a shape to form a pocket for storage.

9. The storage apparatus of claim 1, wherein the closure comprises a closure selected from the groups consisting of a hook and loop material, snap, tie and button.

10. The storage apparatus of claim 1, wherein the closure comprises a hook and loop material.

11. The storage apparatus of claim 1, wherein each region but for the center bottom region comprises a pocket, each said pocket comprising a closing means.

* * * * *